United States Patent [19]

Schaeffler

[11] Patent Number: 4,867,114

[45] Date of Patent: Sep. 19, 1989

[54] SELF-ADJUSTING HYDRAULIC VALVE TAPPET

[75] Inventor: George Schaeffler, Herzogenaurach, Fed. Rep. of Germany

[73] Assignee: INA Walzlager Schaeffler KG, Fed. Rep. of Germany

[21] Appl. No.: 316,456

[22] Filed: Feb. 27, 1989

[30] Foreign Application Priority Data

Apr. 14, 1988 [DE] Fed. Rep. of Germany ..... 3812333

[51] Int. Cl.[4] ..... F01L 1/24

[52] U.S. Cl. ..... 123/90.52; 123/90.55

[58] Field of Search ..... 123/90.52, 90.53, 90.55, 123/90.56, 90.57

[56] References Cited

U.S. PATENT DOCUMENTS

| | | | |
|---|---|---|---|
| 4,373,477 | 2/1983 | Buente et al. | 123/90.55 |
| 4,397,271 | 8/1983 | Gardner | 123/90.55 |
| 4,470,381 | 9/1984 | Buente et al. | 123/90.55 |
| 4,610,225 | 9/1986 | Camosso et al. | 123/90.55 |
| 4,624,225 | 11/1976 | Kowal | 123/90.55 |
| 4,656,978 | 4/1978 | Deuring | 123/90.55 |
| 4,787,347 | 11/1988 | Schaeffler | 123/90.55 |

*Primary Examiner*—Charles J. Myhre
*Assistant Examiner*—Weilun Lo
*Attorney, Agent, or Firm*—Bierman and Muserlian

[57] ABSTRACT

A self-adjusting hydraulic valve tappet disposed in a guide bore of a cylinder head of an internal combustion engine and comprising a cup-shaped housing comprised of a hollow cylindrical wall closed at one end by an end member against the outside of which a cam of a camshaft abuts whereby the actual hydraulic play compensating element is guided for longitudinal movement in a bore of a radial flange located at a distance from the end member, the bore being concentric with the hollow cylindrical wall and the radial flange as separate component consisting of a material having a higher coefficient of expansion than steel and being inserted and fixed in the bore of the hollow cylindrical wall with its external mantle surface in a liquid-proof manner, characterized in that between the end member on one side and the radial flange on the other side a hollow tubular element is disposed which under axial pre-tension bears with one of its axial ends against the end member and with its other axial end against the radial flange whereby at least one oil transfer opening is provided between the other end of the hollow tubular element and the radial flange.

8 Claims, 1 Drawing Sheet

SELF-ADJUSTING HYDRAULIC VALVE TAPPET

STATE OF THE ART

Figure 1:
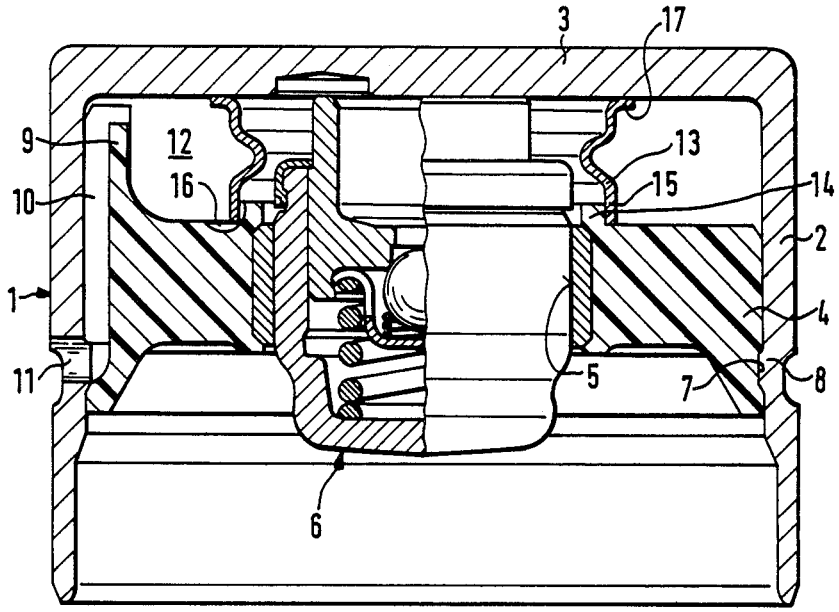

Self-adjusting hydraulic valve tappets have been proposed and by the special choice of material for the radial flange, particularly plastic and aluminium, special fixing procedures such as welding, soldering, glueing or the like can be completely dispensed with. In the simplest version, all that is needed is to press the over-sized radial flange provided with a completely smooth external mantle surface into the equally smooth bore of a hollow cylindrical wall. Because the radial flange has a higher coefficient of expansion than the wall of the hollow cylinder, it is guaranteed that even under the temperature fluctuations occurring in service this interference fit never gets detached, but on the contrary tightens even more.

The fact that the radial flange has a higher coefficient of expansion than the wall of the hollow cylinder can at the same time be put to advantage in another way. In recent times, engine cylinder heads made of light metals are used more and more frequently. A detrimental feature of such constructions is that with increasing heat, the cylinder head expands more than the valve tappet made of steel, which results in an increase of play between the valve tappet and the receiving bore and leads to an undesirably high oil transfer. If the proposed tappet construction is used, this disadvantage can be avoided or at least lessened, if the thickness of the hollow cylindrical wall, at least in the longitudinal section in which the radial flange is disposed, is so small that the radial flange when thermally expanded can make the cylindrical wall expand outwards in an elastic manner. The coefficient of expansion of a light metal and that of a suitable plastic e.g. polyether sulfone being approximately the same, it is thus possible to ensure that the play between the valve tappet and the guide bore remains at least roughly constant in all temperature ranges.

The proposed tappet construction provides that between the radial flange and the hollow cylindrical wall a longitudinal channel is formed at at least one point of the circumference, which channel extends from an oil filling bore to near the end member of the cup-shaped housing. This guarantees that the oil reservoir is not emptied in the standstill phase of the engine.

On the other hand, valve tappets are known which are provided with a cylindrical sleeve extending from the internal surface of the end member of the tappet housing onto which it is fixed, to near the radial flange where it is provided at at least one point of its periphery with an oil inlet opening. The lay-out of such an additional sleeve guarantees that oil is only sucked up from the lower, air-free section of the oil reservoir and transported into the actual play compensating element. In these known constructions, the additional sleeve is as a rule butt welded onto the inner surface of the end member of the housing. Practice has shown that the slight dynamic deflections of the end member which occur in service when the cam abuts against it, load the weld seam between the end member and the sleeve to such an extent that it frequently fractures after a certain service life. Even though by this, the tappet itself does not become inoperative, the advantages gained through this lay-out of the sleeve are, however, lost (DE-OS-3,542,192).

OBJECTS OF THE INVENTION

It is an object of the invention to eliminate this disadvantage and achieve a durable leak-tightness of the sleeve with respect to the oil reservoir independently of the deflections of the base member using simple constructional and particularly hardly more expensive measures.

This and other objects and advantages of the invention will become obvious from the following detailed description.

THE INVENTION

The novel self-adjusting hydraulic valve tappet of the invention disposed in a guide bore of a cylinder head of an internal combustion engine comprises a cup-shaped housing comprised of a hollow cylindrical wall closed at one end by an end member against the outside of which a cam of a camshaft abuts whereby the actual hydraulic play compensating element is guided for longitudinal movement in a bore of a radial flange located at a distance from the end member, the bore being concentric with the hollow cylindrical wall and the radial flange as separate components consisting of a material having a higher coefficient of expansion than steel and being inserted and fixed in the bore of the hollow cylindrical wall with its external mantle surface in a liquid-proof manner, characterized in that between the end member on one side and the radial flange on the other side a hollow tubular element is disposed which under axial pre-tension bears with one of its axial ends against the end member and with its other axial end against the radial flange whereby at least one oil transfer opening is provided between the other end of the hollow tubular element and the radial flange.

Because the hollow tubular element provided bears against the end member on the one side and the radial flange on the other side solely by the axial pre-tension without the need of additional fixing measures like soldering, welding or the like, it is assured on the one hand that any risk of fracture is excluded and on the other, that durable oil-tightness is guaranteed.

The hollow tubular element can e.g., have the longitudinal sectional profile of a tubular folding bellow but it can also be expedient to provide this hollow tubular element with a funnel-shaped longitudinal section so that one of its axial ends lies against the end member near its outer diameter and the other axial end near the bore of the radial flange. This is a sure manner of preventing deflections of the end member which have their largest amplitude at the center of the end member from acting on the hollow tubular element. It is expedient to make the hollow tubular element out of steel sheet, particularly out of spring steel sheet, to ensure that the desired pre-tension is maintained throughout the service life.

The radial flange can be provided with a centering rim which interlocks with the corresponding end of the hollow tubular element and thus guarantees that this latter always remains in its correct position even in the radial direction. The end of the hollow tubular element which bears against the end member can be provided with a marginal section running parallel to the end member, thus establishing not only a linear, but a surface contact for the purpose of an assured liquid-tightness.

Figure 2:
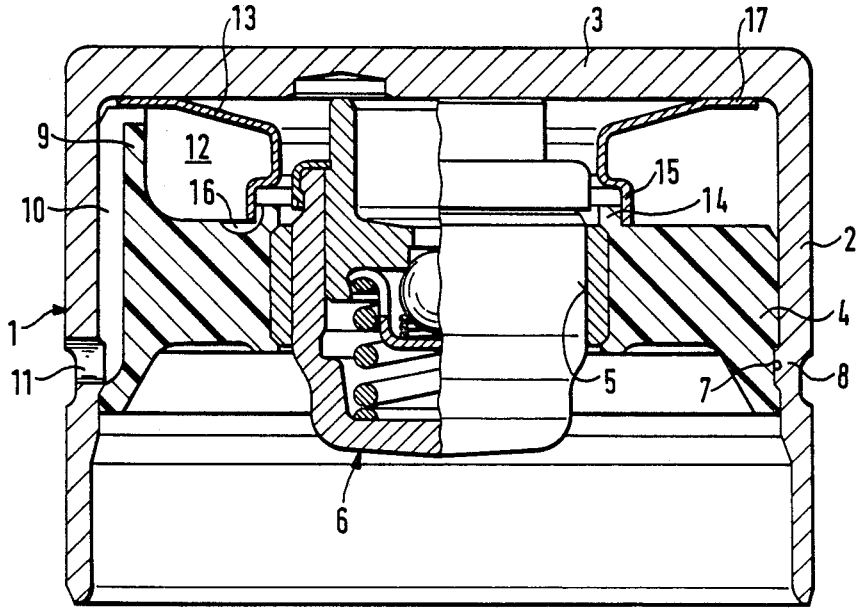

Referring now to the drawings:

FIGS. 1 and 2 are longitudinal cross-sections of different embodiments of the invention.

The valve tappet shown in FIG. 1 has a cup-shaped housing 1 made up of the hollow cylindrical wall 2 which is closed at the upper end by an end member 3. At a distance from the end member 3, a radial flange 4 is provided in the bore of the hollow cylinder 2 to lodge the actual play compensating element 6 for longitudinal movement in its bore 5 which is concentric with the hollow cylindrical wall 2. Whereas the cup-shaped housing 1 is made of steel, the radial flange 4 consists of a polymer material.

The fixing of the radial flange 4 in the bore of the hollow cylindrical wall 2 is effected by providing the radial flange 4 with a peripheral groove 7 on its outer mantle surface in which projection 8 engages. At one point of its periphery, the radial flange 4 is provided with an axial prolongation 9 which together with the hollow cylindrical wall 2 defines a longitudinal channel 10 which begins at an oil feeding bore 11 and ends near the end member 3 in the oil reservoir 12.

Between the end member 3 on one side and the radial flange 4 on the other, a hollow tubular element 13 is provided which is held between these two parts under axial pre-tension. The hollow tubular element 13 is provided in this case with the longitudinal sectional section profile of a tubular folding bellow which in this example has only one fold. The radial flange 4 is provided with a centering rim 14 which interlocks with the lower end 15 of the hollow tubular element 13. In this region, an oil transfer opening 16 in the form of a grooveshaped cut-out is provided at at least one point of the circumference of the radial flange 4. At the opposite end of the hollow tubular element, a marginal section 17 runs parallel to the end member 3 thus establishing surface contact with the end member 3.

The valve tappet of FIG. 2 distinguishes itself from that of FIG. 1 only in that the hollow tubular element has a funnel-shaped longitudinal section which enables the hollow element to bear against the end member near its outer diameter with one of its axial ends. In this way, deflections of the end member 3 in service have practically no influence on the holow tubular element 13.

Various modifications of the valve tappet of the invention may be made without departing from the spirit or scope thereof and it is to be understood that the invention is intended to be limited only as defined in the appended claims.

What I claim is:

1. A self-adjusting hydraulic valve tappet disposed in a guide bore of a cylinder head of an internal combustion engine and comprising a cup-shaped housing comprised of a hollow cylindrical wall closed at one end by an end member against the outside of which a cam of a camshaft abuts wherein an actual hydraulic play compensating element is guided for longitudinal movement in a bore of a radial flange located at a distance from the end member, the bore being concentric with the hollow cyindrical wall, and the radial flange being a separate component consisting of a material having a higher coefficient of expansion than steel and being inserted and fixed to the hollow cylindrical wall, said radial flange having an external mantle surface forming a leak-proof seal, characterized in that between the end member on one side and the radial flange on the other side a hollow tubular element is disposed which under axial pretension bears with one of its axial ends against the end member and with its other axial end against the radial flange wherein at least one oil transfer opening is provided between the other end of the hollow tubular element and the radial flange.

2. A valve tappet of claim 1 wherein the hollow tubular element has the longitudinal sectional profile of a tubular folding bellow.

3. A valve tappet of claim 1 wherein the hollow tubular element has a funnel-shaped longitudinal section, the one axial end of which bears against the end member near the outer diameter of the latter.

4. A valve tappet of claim 1 wherein the radial flange is made of a material having a coefficient of expansion similar to that of aluminium.

5. A valve tappet of claim 1 wherein the hollow tubular element is made of steel sheet.

6. A valve tappet of claim 1 wherein the hollow tubular element is made of spring steel sheet.

7. A valve tappet of claim 1 wherein the radial flange is provided with a centering rim which interlocks with the other end of the hollow tubular element.

8. A valve tappet of claim 1 wherein the hollow tubular element has at its one end which bears against the end member, a marginal section running parallel to the end member.

* * * * *